United States Patent [19]

Hasumi et al.

[11] Patent Number: 4,728,205

[45] Date of Patent: Mar. 1, 1988

[54] POSITIONING OF DAMPENERS IN A WIRE MATRIX PRINT HEAD

[75] Inventors: Hitoshi Hasumi; Hirofumi Hirano, both of Saitama, Japan

[73] Assignee: Canon Kabushiki Kaisha, Tokyo, Japan

[21] Appl. No.: 35,236

[22] Filed: Apr. 6, 1987

Related U.S. Application Data

[63] Continuation of Ser. No. 732,627, May 10, 1985, abandoned.

[30] Foreign Application Priority Data

May 15, 1984 [JP] Japan ..... 59-95720
May 15, 1984 [JP] Japan ..... 59-95721
May 15, 1984 [JP] Japan ..... 59-95722

[51] Int. Cl.[4] ..... P41J 3/12
[52] U.S. Cl. ..... 400/124; 101/93.05
[58] Field of Search ..... 400/121, 124, 157.2, 400/167; 101/93.02, 93.04, 93.05

[56] References Cited

U.S. PATENT DOCUMENTS 4,009,772 3/1977 Glaser et al. ..... 400/124
4,552,064 11/1985 Sanders, Jr. et al. ..... 400/124
4,555,192 11/1985 Ochiai ..... 400/124
4,594,010 6/1986 Jachno ..... 400/124

*Primary Examiner*—David Wiecking
*Attorney, Agent, or Firm*—Fitzpatrick, Cella, Harper & Scinto

[57] ABSTRACT

An impact type dot head for forming a character, symbol or the like by a dot matrix comprises: four printing wires arranged in a line in a wire holder; a guide member to guide the wires in parallel; four drive units each for pushing the rear edge of the wire in its axial direction and allowing the front edge of this wire to be projected to the printing position; and a foredamper consisting of a silicone rubber serving as a vibration damping material attached to the holder along its side surface. The drive unit includes an armature to clap the rear edge of the wire and an electromagnetic member to attract the armature. Each printing wire comprises a long thin-diameter portion on the front edge side, a short thick-diameter portion near the rear edge side and an intermediate taper portion connecting them. A coil spring having a diameter which is larger than the diameter of the front edge of the wire and is smaller than the thick portion is elastically attached to the wire, thereby allowing the wire to be pushed and returned from the printing position to the original portion. The printing wires therefore can be accurately guided with a simple and inexpensive structure and printing noise can be reduced.

6 Claims, 8 Drawing Figures

POSITIONING OF DAMPENERS IN A WIRE MATRIX PRINT HEAD

This application is a continuation of application Ser. No. 732,627 filed 5/10/85, now abandoned.

BACKGROUND OF THE INVENTION

1. Field of the Invention

The present invention relates to an impact type dot head and, more particularly, to an impact type dot head having a plurality of printing wires and electromagnetic means for driving these wires in which a character, a symbol or the like is formed by a dot matrix.

2. Description of the Prior Art

With the spread of personal computers, demand for printers as their output apparatuses has been steadily increasing. However, an inexpensive and quiet printer with a low operating cost while having performance capability which can meet the needs of home or personal use is not available in the market.

Among various kinds of printing systems presently available, special paper is needed for a thermal system and a transfer ribbon is necessary for a thermal transfer system In addition, there is a drawback that the operating cost is high in both systems. An ink jet system has drawbacks in that the mechanism and control are complicated and the apparatus is expensive. The impact system of the present invention, has a low operating cost and inexpensive construction when compared with other systems; however, a problem exists with the arrangement of wires.

Practically speaking, as shown in FIG. 8, in a conventional structure, each wire W is obliquely arranged and is constructed such that the distance between the edges of the wires can be minimized.

For this purpose, the position of a guide hole adapted to guide each wire differs entirely and it is difficult to provide accurate alignment.

In addition, the printer of the above-mentioned impact system is noisy and heat is generated due to the use of an electromagnet.

SUMMARY OF THE INVENTION

It is an object of the present invention to provide a suitable impact type dot head.

Another object of the invention is to allow a wire to be accurately guided with a simple structure.

Still another object of the invention is to reduce the noise.

Other objects of the present invention will become apparent from the following detailed description with reference to the accompanying drawings.

BRIEF DESCRIPTION OF THE DRAWINGS

FIGS. 1 to 7 are diagrams to explain one embodiment of the present invention, in which:

FIG. 1 is an exploded perspective view;

FIG. 2 is a rear elevational view of a coil portion;

FIGS. 3 and 4 are side elevational views with a part cut away;

FIG. 5 is an explanatory view of a printing wire;

FIG. 6 is a cross sectional view;

FIG. 7 is a diagram to explain the operation; and

DETAILED DESCRIPTION OF THE PREFERRED EMBODIMENT

Figure 1:
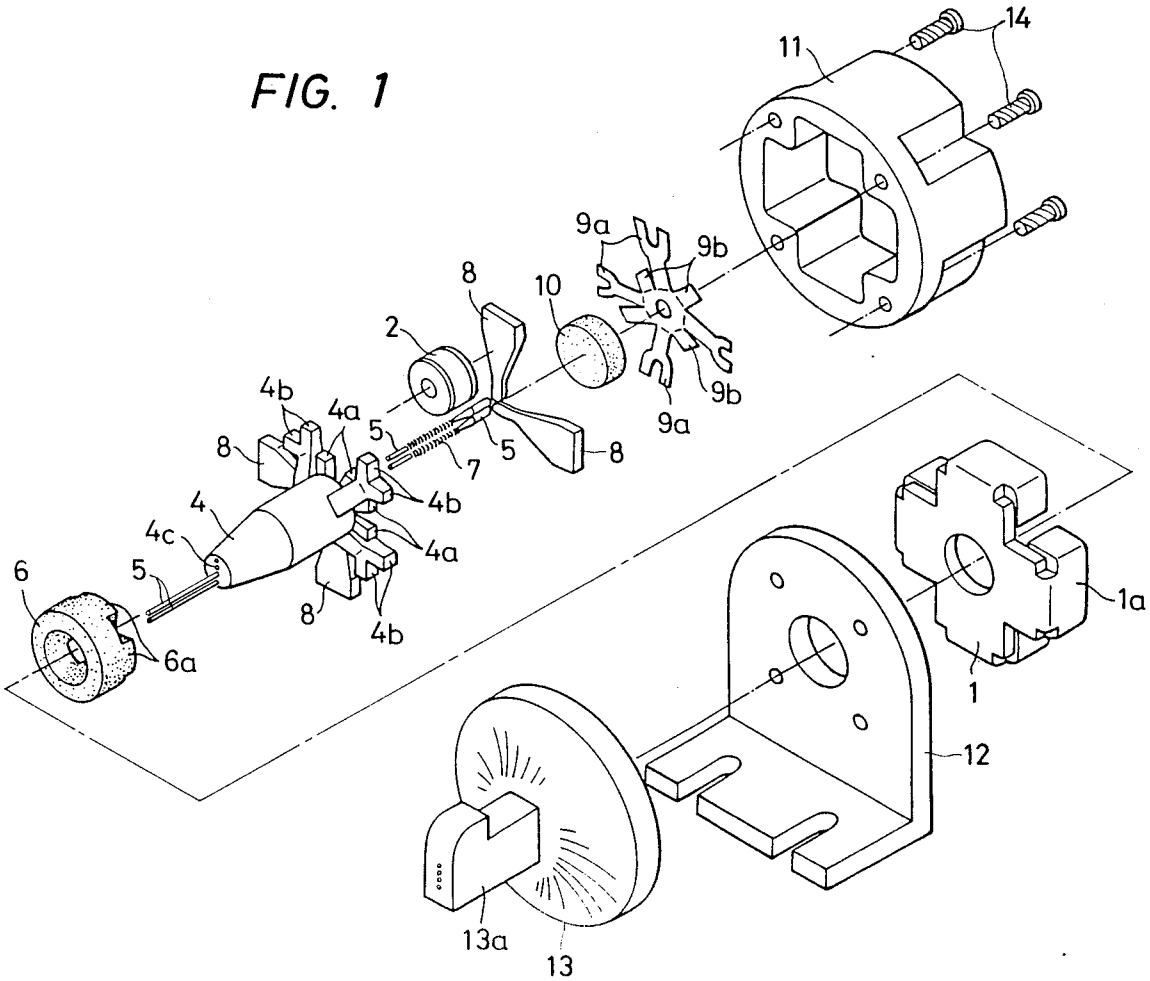

FIGS. 1 to 7 are diagrams to explain one embodiment of the present invention, in which an overall exploded perspective view is shown in FIG. 1.

Figure 2:
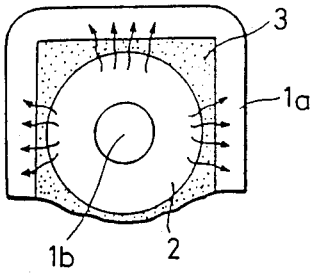

In FIG. 1, a yoke 1 is formed from a plate of magnetic material. Yoke 1 is formed with four iron cores 1*b* (FIGS. 2 and 6) consisting of magnetic material. Yoke 1 is bent in parallel with iron cores 1*b* so as to surround them in a U-shape, thereby forming arm portions 1*a*. All of the edge surfaces of arm portions 1*a* and iron cores 1*b* are ground so that they are on the same plane. In addition, coils 2 are mounted on each of iron cores 1*b* so as to surround them. Also, a member 3 having a high coefficient of thermal conductivity (for example, silicone rubber or the like) is sealingly interposed in the gap between coil 2 and yoke 1 as shown in FIG. 2, thereby fixing coil 2 to yoke 1.

Figure 3:
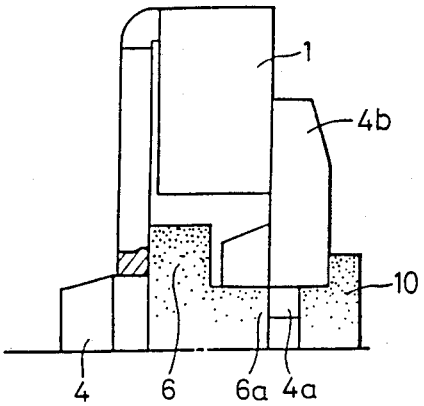
Figure 4:
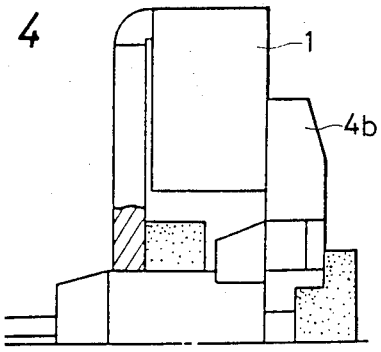

Similarly, in FIG. 1, holes 4*c* adapted to guide wires 5 are formed at the central portion of a holder 4. Four holes 4*c* are formed in holder 4, to guide wires 5 and four wires 5 are supported such that they are slidable in their axial directions along these holes and arranged in parallel with one another. Further, holder 4 also supports a foredamper 6. Foredamper 6 has a cylindrical shape and is formed from a vibration damping material (for example, vibration isolation rubber). Notches are formed in one cross sectional portion of foredamper 6 and projecting portions 6*a* are formed. Foredamper 6 engages holder 4 along the side surface of the cylindrical portion of holder 4. In this state, holder 4 is inserted into the hole formed at the center of yoke 1. Thereafter, as shown in FIGS. 3 and 4, projecting portions 6*a* of foredamper 6 are pressed to yoke 1 by means of arms 4*a* formed to holder 4, thereby positioning the edge surfaces of projecting portions 6*a*. At the same time, foredamper 6 can be bent until Y-shaped arms 4*b* of holder 4, which serves to position a yoke 1, is brought into contact with the ground surfaces of yoke 1, thereby restricting the position in the axial direction of holder 4. Thus, the position of the edge surface of projecting portion 6*a* to the edge surface on the side of yoke 1, namely, to the edge surface of iron core 1*b* is determined only by the dimension between two arms 4*a* and 4*b* of the holder 4, so that foredamper 6 can be accurately held. Foredamper 6 will be described with reference to FIGS. 3 to 4.

Figure 5:
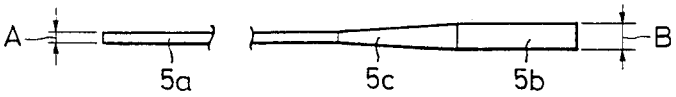
Figure 8:
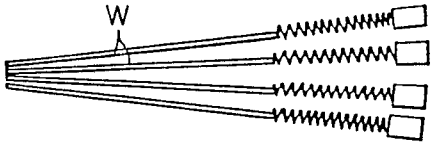
FIG. 8 is an explanatory diagram showing a conventional wire arrangement.
Figure 6:
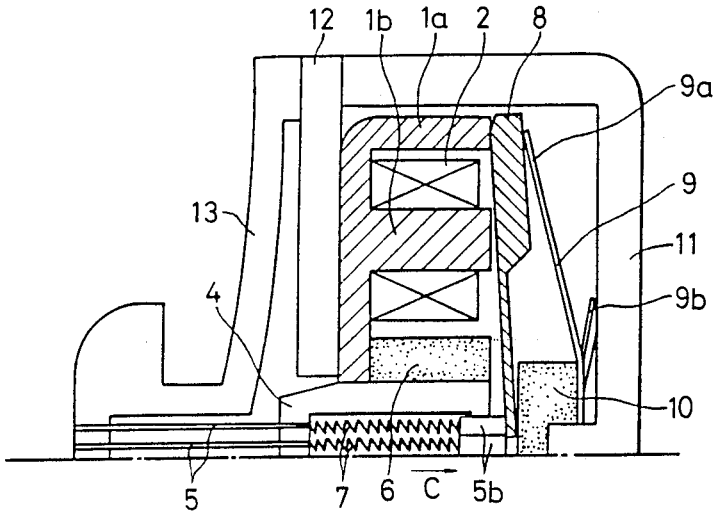

As shown in FIG. 5, wire 5 in FIG. 1 comprises a long thin-diameter portion 5*a*, a short thick-diameter head portion 5*b* and a taper portion 5*c* to couple both portions 5*a* and 5*b*. Taper portion 56 is formed from the same material as portions 5*a* and 5*b*. A diameter A of thin-diameter portion 5*a* of wire 5, the diameter of the printed dot, is ordinarily 0.3 mm and the distance between the dots in the vertical direction is 0.423 mm. In a conventional printing head, the distance between wires 5 is similar to that described above, where eight to nine wires are arranged. However, in the present embodiment, the number of wires 5 is reduced to four and the distance between the wires is set to 0.846 mm. The diameter B of the head portion 5*b* of wire 5 is set to the same value of 0.846 mm. Consequently, thin-diameter portions 5*a* of wire 5 can be slidably supported at the same interval and can be easily arranged in parallel simultaneously. Each return spring 7 is designed so as to satisfy the relations of $A<D_1<B$, and $D_2<B$ with respect to its inner diameter $D_1$ and outer diameter $D_2$. As shown in FIG. 6, return spring 7 is pierced by wire 5 and is inserted into holder 4. A pressing force is applied to return spring 7 so that taper portion 5c is pushed and wire 5 is always pushed in the direction indicated by an arrow C in FIG. 6. The wire portion will be explained with reference to FIGS. 5 and 6.

Also in FIG. 1, armatures 8 are illustrated. As shown in FIG. 6, the wide edge portion of armature 8 is supported in contact with the ground surface of arm portion 1a of the yoke 1, while the other end pushes the edge of wire head portion 5b. The wide edge of armature 8 is pressed to arm portion 1a of yoke 1 by means of a presserbar spring 9, so that armature 8 can be rotated around this pressed portion as a fulcrum. On the other hand, the portion of the armature 8 located between iron core portion 1b and arm portion 1a of yoke 1 is thickly formed thick and the portion on the side of wire head portion 5b is thin, thereby reducing the inertia mement around the rotational fulcrum as a center.

Next, a backdamper 10 in FIG. 1 is formed from a vibration damping material (for instance, a rubber vibration isolation or the like). Backdamper 10 is pushed by a stopper formed in holder 4 and restricts its position. Namely, the position of backdamper 10 is restricted by only the dimension of holder 4 similarly to foredamper 6, so that the gap between backdamper 10 and iron core portion 1b can be accurately held. As described above, arms 9a of the presser bar spring 9 serve to press armatures 8, while other arms 9b are bent in the direction of the surfaces opposite to arms 9a and are pressed by the inner surface of backholder 11 as shown in FIG. 6. The pressing force applied by arms 9b of presser bar spring 9 at this time is stored in such a manner that a part of this force is transferred to armatures 8 through arms 9a and another part is transferred through backdamper 10. These partial forces are used for positioning at arms 4a of holder 4, while still another part is transferred through arms 4a of holder 4 to foredamper 6, thereby slightly deforming projecting portion 6a. Further, the remaining part of the pressing force deforms backdamper 10 itself and is stored therein and simultaneously serves to position the edge surface of backdamper 10. Backdamper 10 will be described with reference to FIG. 6.

In FIG. 1, yoke 1 is attached to a spacer 12 formed of a metal plate having an excellent coefficient of thermal conductivity (for instance, aluminum plate or the like) such that the whole surface of the side portion of yoke 1 comes into contact with spacer 12. A foreholder 13 is fastened in front of yoke 1 through spacer 12 by means of backholder 11 and screws 14. The edge of the thin-diameter portion 5a of wire 5 is slidably supported to a head guide portion 13a of foreholder 13.

FIG. 2 is a cross sectional view of coil 2 of this embodiment, in which iron core portion 1b consisting of a magnetic material formed in arm portion 1a of yoke 1 is shown. Coil 2 is arranged around iron core portion 1b and member 3 having a high thermal conductivity is embedded in the gap between coil 2 and arm portion 1a. Member 3 serves to efficiently transfer the heat generated by coils 2 to yoke 1.

FIGS. 3 and 4 are vertical sectional side elevational views of the embodiment. As shown in the diagrams, foredamper 6 and backdamper 10 are fixed to holder 4. Projecting portion 6a of foredamper 6 is in contact with arm 4a of holder 4, while arm 4b cannot be deformed but can come into contact with the edge surface of yoke 1, so that foredamper 6 can be held with a high degree of precision. Backdamper 10 comes in contact from the direction opposite to foredamper 6 with respect to arms 4a, so that it can be accurately held.

The operation in the foregoing arrangement as shown in FIGS. 1 to 6 will now be further explained.

Figure 7:
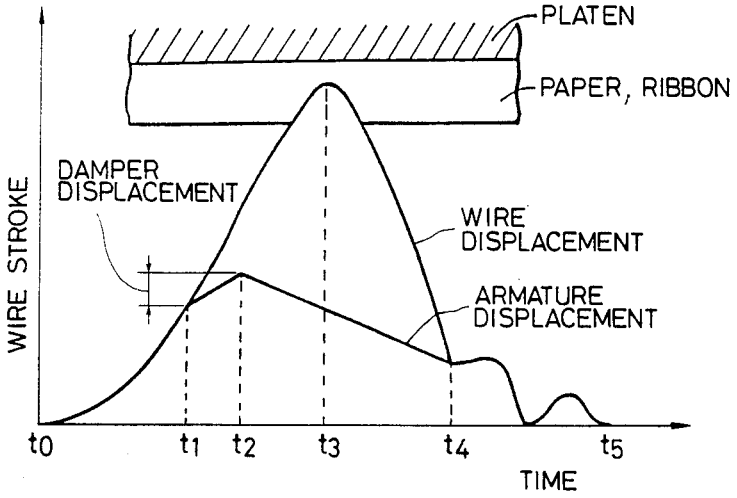

A fundamental mechanism is such that when a current flows through the electromagnet formed by coils 2 and iron core portions 1b, the electromagnet attracts armatures 8 and allows wires 5 to slide against return spring 7. FIG. 7 is a diagram showing the elapsed time as an axis of abscissa and the wire stroke, namely, deformation as an axis of ordinate in which the origin corresponds to the time $t_0$ when the electromagnet is turned on. In the initial time when the electromagnet start attracting armatures 8, that is, during the period between $t_0$ and $t_1$, both of armature 8 and wire 5 are moving freely. However, at time $t_1$, armature 8 collides with foredamper 6 formed from a vibration damping material and is stopped at time $t_2$. Thereafter, it starts deformation in the opposite direction due to the rebounding force of foredamper 6. However, wire 5 is continuously moved after time $t_1$ since it is not fixed to armature 8 and does not collide with foredamper 6.

In this case, since the force is applied to wire 5 in the opposite direciton due to return spring 7, the force is balanced at time $t_3$ and after wire 5 reaches the maximum displacement, it is returned to the original position due to the force of return spring 7. At this maximum displacement, the point (i.e., front edge), of the wire 5 exerts the impact force to the printing paper and ribbon (not shown), so that the recording is performed on the printing paper. Thereafter, the displacements of armature 8 and wire 5 become equal at time $t_4$ and subsequently change together. After completion of the attenuation vibration in this way, armature 8 and wire 5 are returned to their original states at time $t_5$. As described above, insertion of foredamper 6 makes it possible to remarkably reduce the printing noise.

The present invention is not limited to the foregoing embodiment but it can be also applied to the system in which armature 8 and wire 5 are integrally formed or to the spring charge type instead of the clapper type as shown in the embodiment.

As will be obviously understood from the above description, according to the present embodiment, the number of wires may be reduced and the wires may be arranged in parallel and the head portions of the wires may be slideably moved while maintaining contact Therefore, a printer utilizing the present invention can be easily and inexpensive manufactured and assembled.

In addition, in the conventional system, the wires having a constant length are needed to reduce the distance between the head portions of the wires. However, in the preferred embodiment of the present invention in which the wires are arranged in parallel, the lengths of the wires can be shortened and the inertia mass of each wire reduced, resulting in a reduction in electric power consumption.

Further, the yoke and iron core are arranged such that their edge surfaces are on the same plane. The sliding position of the armature to drive the wire and the holder to restrict the gap between the iron core and the armature are arranged so as to be positioned by means of the edge of the yoke. Therefore, the sliding width of the armature and the gap can be accurately controlled through merely a single member.

What we claim is:

1. An impact type dot head comprising:

a plurality of printing wires;

wire drive means having a plurality of armatures to move said printing wires toward a projecting direction and an electromagnetic member for operating said armatures;

first stopping means having a first surface which is impacted by said armatures when said wires are moved in the projecting direction for limiting movement of said armatures in said projecting direction;

second stopping means having a second surface which is impacted by said armatures when said wires are returned in an opposite direction to said projecting direction for limiting movement of said armatures in said opposite direction;

guide means for guiding said wires movably in said projecting direction and said opposite direction, said guide means including a cylindrical guide portion whose axis is in said projecting direction, positioning means extending radially from said cylindrical guide portion and having a first positioning surface for engaging the first surface of said first stopping means to determine the position of the first surface relative to said guide means in the projecting direction, and a second positioning surface for engaging the second surface of said second stopping means to determine the position of the second surface relative to said guide means in a direction axially opposite from the projecting direction; and means engaging and fixing said positioning means, said first stopping means and said second stopping means in a state where said first surface engages said first positioning surface and said second surface engages said second positioning surface.

2. A dot head according to claim 1, wherein:

said fixing means includes a backholder for covering said drive means, a foreholder for covering said guide means, and screw means for fixing said backholder and said foreholder to each other to thereby engage and fix said guide means, said first stopping means and said second stopping means.

3. A dot head according to claim 1, further comprising a yoke member holding said electromagnetic member wherein magnetic flux generated by said electromagnetic member passes through said yoke member and said armatures, said positioning means has a third positioning surface for determining the position of said yoke member relative to said guide means.

4. A dot head according to claim 1, wherein said printing wires comprise four wires in a row, and said armatures comprise four armatures located in substantially a cross arrangement such that the apical end of each of said four armatures is located at the rear end of each of said four wires.

5. A dot head according to claim 4, wherein said wires are formed such that the diameters of the rear ends thereof are greater the diameters of the front ends and said guide means rectlinearly guides said wires.

6. A dot head according to claim 5, also including coil springs to urge each of said wires toward contact with said second stopping means, each of said coil springs having a diameter greater than said diameters of said front ends of said wires and smaller than said diameters of said rear ends of said wires.

* * * * *

UNITED STATES PATENT AND TRADEMARK OFFICE

CERTIFICATE OF CORRECTION

PATENT NO. : 4,728,205

DATED : March 1, 1988

INVENTOR(S) : HITOSHI HASUMI, ET AL.

It is certified that error appears in the above-identified patent and that said Letters Patent is hereby corrected as shown below: On The Title Page:

[56] REFERENCES CITED

Insert --4,230,412 10/1980 Hebert .....400/124; 4,367,962 1/1983 Gaboardi .....400/124; 4,396,304 8/1983 Davenport, et al. .....400/124; 4,407,591 10/1983 Adamoli, et al. .....400/124.

COLUMN 1

Line 25, "system In" should read --system, In--.

Line 30, "invention," should read --invention--.

Line 65, "cross sectional" should read --cross-sectional--.

COLUMN 2

Line 22, "holder 4," should read --holder 4--; and "wires 5" should read --wires, 5--.

Line 29, "cross sectional" should read --cross-sectional--.

Line 52, "Taper portion 56" should read --Taper portion 5c--.

COLUMN 3

Line 19, "thickly formed" should be deleted.

Line 21, "mement" should read --moment--.

Line 23, "rubber vi-" should read --vibration isolation rubber--.

UNITED STATES PATENT AND TRADEMARK OFFICE

CERTIFICATE OF CORRECTION

PATENT NO. : 4,728,205

DATED : March 1, 1988

INVENTOR(S) : HITOSHI HASUMI, ET AL.

It is certified that error appears in the above-identified patent and that said Letters Patent is hereby corrected as shown below:

Line 24, "bration isolation" should be deleted.
Line 56, "cross sectional" should read --cross-sectional--.

COLUMN 4

Line 27, "direciton" should read --direction--.
Line 32, "(i.e., front edge), of the wire 5" should read --(i.e., the front edge), of wire 5--.
Line 51, "contact" should read --contact.--.
Line 53, "inexpensive" should read --inexpensively--.

COLUMN 6

Line 17, "armatures, said" should read --armatures, and said--.

Signed and Sealed this

First Day of November, 1988

*Attest:*

*Attesting Officer*

DONALD J. QUIGG

*Commissioner of Patents and Trademarks*